US005626171A

United States Patent [19]

Mirri

[11] Patent Number: 5,626,171

[45] Date of Patent: May 6, 1997

[54] APPARATUS FOR MEASURING AND DISPENSING PREDETERMINED AMOUNTS OF POWDERED MATERIAL

[75] Inventor: Nerio Mirri, Imola, Italy

[73] Assignee: I.M.A. Industria Macchine Automatiche S.p.A., Italy

[21] Appl. No.: 424,617

[22] Filed: Apr. 19, 1995

[30] Foreign Application Priority Data

Apr. 22, 1994 [IT] Italy ..... BO94A0175

[51] Int. Cl.[6] ..... B65B 1/00

[52] U.S. Cl. ..... 141/152; 141/81; 141/145; 141/94; 141/181; 141/258

[58] Field of Search ..... 141/11, 12, 69, 141/71, 81, 94, 144–147, 181, 258, 270, 283

[56] References Cited

U.S. PATENT DOCUMENTS

| | | | |
|---|---|---|---|
| 3,656,517 | 4/1972 | Taylor et al. | 141/144 X |
| 4,060,109 | 11/1977 | Sotoma | 141/152 X |
| 4,062,386 | 12/1977 | Zanasi | 141/258 |
| 4,108,221 | 8/1978 | Freimuth et al. | 141/146 |
| 4,116,247 | 9/1978 | Zanasi | 141/81 X |
| 4,122,876 | 10/1978 | Nalbach | 141/152 X |
| 4,326,568 | 4/1982 | Burton et al. | 141/146 X |
| 5,111,642 | 5/1992 | Chiari | 141/81 X |
| 5,240,049 | 8/1993 | Chiari | 141/81 |

FOREIGN PATENT DOCUMENTS

| | | |
|---|---|---|
| 699953 | 11/1967 | Belgium . |
| 0319131 | 6/1989 | European Pat. Off. . |
| 2130159 | 3/1972 | Germany . |
| 4140305 | 6/1992 | Germany . |

*Primary Examiner*—J. Casimer Jacyna
*Attorney, Agent, or Firm*—Larson and Taylor

[57] ABSTRACT

The mechanism (27, 28) which regulates the volume of the distributors (16, 116) is connected to a shaft (41) coaxial to the shaft of the distributor carrousel. When the motor (63) is at standstill, the two coaxial shafts (2,41) rotate in the same direction and at the same speed. Whenever the motor (63) is activated in one direction or the other with the carrousel at the standstill or rotating, the inner shaft (41) rotates relative to the outer shaft (2), in the direction and to the extent necessary for the required regulation of volume of the distributors. The volume of the distributors is controlled remotely by a programmable processor (77).

12 Claims, 4 Drawing Sheets

APPARATUS FOR MEASURING AND DISPENSING PREDETERMINED AMOUNTS OF POWDERED MATERIAL

BACKGROUND OF THE INVENTION

The invention relates to machines for packaging doses of medicinal product in hard gelatine capsules.

More particularly, the invention relates to an apparatus for measuring and dispensing predetermined amounts of powdered material used in composite machines of the type which operate intermittently and are provided with at least one vertical axis carrousel, to which there are attached the bodies of tube-type volumetric distributors which are also vertical, with the open end of the tube oriented downwards, at which end a movable plunger is thrust upwards by elastic means, and is provided radially with a projection which extends from the said body through a longitudinal slot, and which is normally supported against stops which are supported by a plate fitted onto the said carrousel, and connected to the latter by axial adjustment means. By adjusting these adjustment means, the said plate with the stops can be lowered or raised in order to raise or lower the plunger of the distributors, and thus respectively increase or decrease the useful volume of the tube of the distributors.

In the machines in question, the tube-type distributors are mounted on the carrousel in two opposite groups, and the carrousel is alternately rotated by 180° and raised and lowered in order to insert the tube of a group of distributors in a store beneath, which contains a correct layer of the product in powder and/or granule form to be distributed, such that the free chamber of the tube is filled uniformly with product. By means of the carrousel which supports them, the distributors are plunged into the store of product, then raised, rotated by 180° and aligned with the bases of capsules which are supported by the carrousel for handling the hard gelatine capsules. At this point the distributors with the dose of product are lowered and abutted with the base of the capsules into which they unload the dose of product when respective thrust devices act on the movement pieces of the distributors. When the dose of product has been unloaded, the thrust devices rise in order to enable the plunger of the distributors to return resiliently into the high, cycle start position, after which the distributors are also raised and returned to cooperate with the store of product, for repetition of a new work cycle.

According to the present state of the art, in order to vary the dose of product formed by the distributors, it is necessary to adjust the machine when it is at a standstill, and alter manually the said means of adjustment of the axial position of the distributor plungers. This regulation must be carried out at the beginning of each work cycle of the machine, and normally also within a single work cycle, owing to variables associated for example with pressure, temperature and humidity of the working environment or the product used, or other parameters of use, which can modify the weight of the doses of product formed in succession by the distributors, even if their distribution chamber remains volumetrically unaltered. In order to limit these variables, the greatest possible control is maintained over all the operating parameters of the machine which could generate these variables, and the machine is sometimes also installed in a controlled atmosphere chamber, this condition often also being necessary because of requirements of sterility in processing the medicinal product to be packaged, and/or in order to avoid dispersion of the latter in the external environment where the operators are located. In order to limit the negative consequences which can arise in production, as a result of these variables, use is also known of means which check statistically the weight of the capsules with the doses of products formed by the distributors, and which indicate whether the weight detected is within the predetermined limit values, or whether it is above or below these limits, also specifying the size of the error. On the basis of this information, the operator can alter the adjustment means for regulation of the volume of the distributors, and in serious cases, can stop the machine.

The problems raised by the known art can be summarised as follows:

- The presence of highly qualified employees is required in order to set the distributor carrousel correctly at the start of each work cycle, control the operation of the carrousel and to carry out any necessary adjustments of volume of the distributors;
- If adjustment is necessary, the entire machine must be stopped, and if there is a controlled atmosphere chamber, adjustment must be carried out from the exterior, through a porthole and wearing rubber gloves, and thus in a manner which is not at all convenient;
- Cyclical stoppages of the machine in order to carry out the said adjustments of volume of the distributors can affect the balance of operation of the machine, cancelling out or delaying the effects which should be derived from the adjustments.

SUMMARY OF THE INVENTION

The object of the invention is to eliminate these and other disadvantages, by means of the following solution.

The shaft of the carrousel is axially hollow, and another shaft is inserted therein, the upper end of which is kinematically connected to the means of axial adjustment of the plate with the stops for stopping the movement pieces of the tube-type distributors. The lower ends of the two shafts are grooved, and are kinematically connected to one another by means of two sets of gears and a reduction/differential gear unit which supports a two-way electric motor provided with a brake which is fitted on the adjustment shaft. An encoder is also provided, for detecting the phase and speed of rotation of the said inner shaft of the distributor carrousel. When the adjustment motor is at a standstill, the kinematic mechanism which comprises the said reduction/differential gear unit, is such that the rotation which the main motor of the machine transmits to the said outer shaft of the distributor carrousel, is transmitted to the inner shaft at the same speed and in the same direction. When the volume of the volumetric distributors needs to be adjusted, the said adjustment motor of the reduction/differential gear unit is actuated in the direction of rotation required, thus giving rise to rotation of the inner shaft in the correct direction relative to the outer shaft, and to consequent axial movement of the upper plate with the stops for the movement pieces of the distributors, to which the necessary correction is thus made. This adjustment can be carried out whether the distributor carrousel is at a standstill or rotating. By means of the encoder of the main motor of the machine, which indirectly provides the phase and speed of rotation of the outer shaft of the distributor carrousel, and by means of the encoder which provides the phase and speed of the inner shaft of the carrousel, a processor monitors the speed of rotation of the two co-axial shafts, and controls and monitors the extent of sliding to be imparted to these shafts, with activation of the inner shaft, in order to obtain the necessary correction of volume of the distributors. This processor is provided with the data for setting the volume of the distributors and/or for the necessary corrections of the volume, via a keyboard and screen, and via the weighing system which monitors cyclically the weight of the full capsules of product when closed and unloaded from the machine.

BRIEF DESCRIPTION OF THE DRAWINGS

Further features and advantages of the invention will become more apparent from the following description of a preferred embodiment, illustrated purely by way of non-limiting example, in the four attached sheets of drawings, in which.

DESCRIPTION OF THE PREFERRED EMBODIMENT OF THE INVENTION

Figure 1:
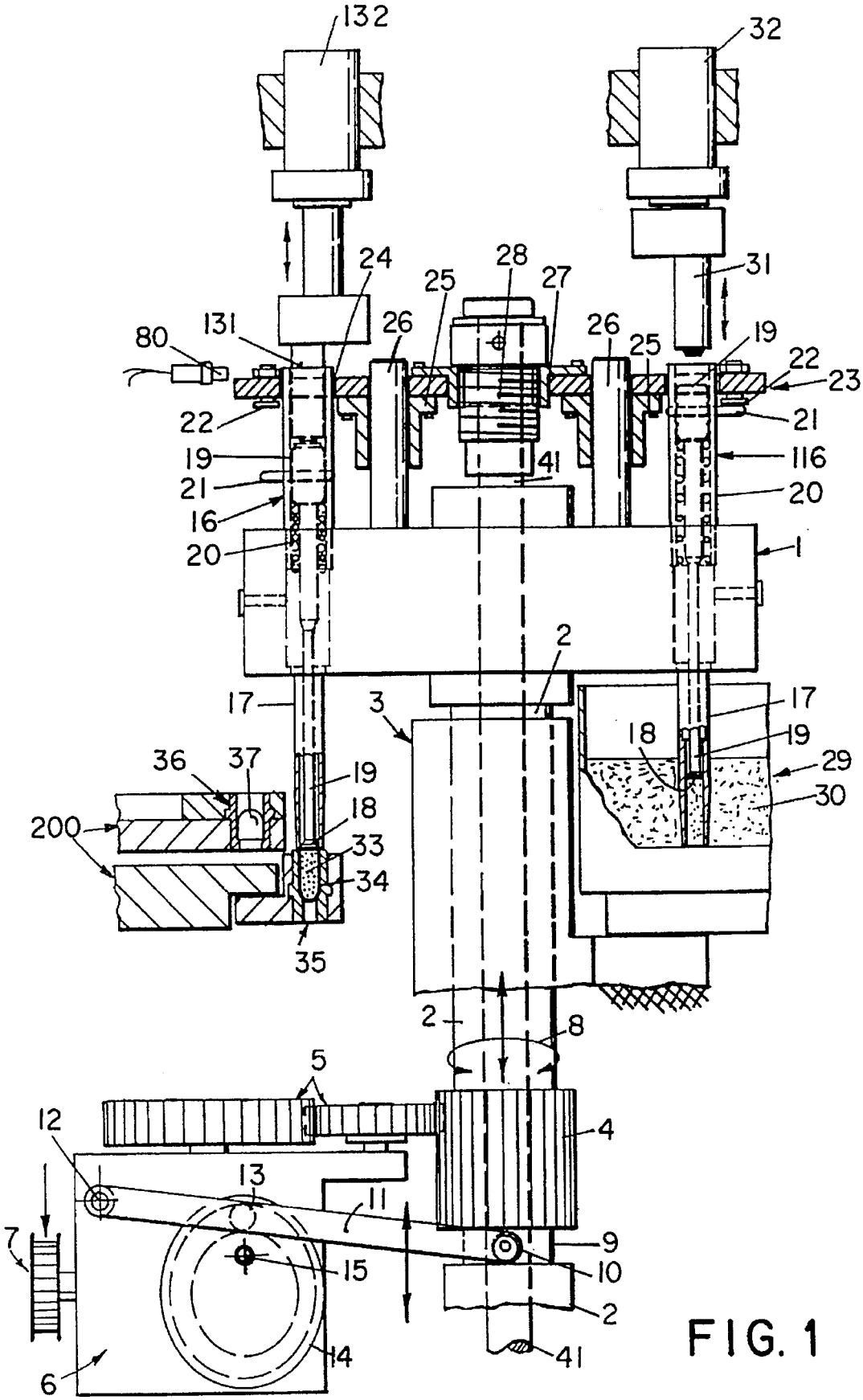
FIG. 1 is a lateral, schematic view partly in cross-section of the central and upper components of the distributor support carrousel.

In FIG. 1, 1 indicates a carrousel of a known type for supporting tube-type volumetric distributors, the vertical shaft 2 of which is supported such as to rotate by the support 3, and is provided in an intermediate part with a pinion 4 of a height suitably greater than the axial movement to which this shaft is cyclically subjected (see below), and which by means of the gear pair 5 is connected to a device 6 of a known type, the input 7 of which is connected to the main motor unit 100 (FIG. 3) of the carrousel 200 for handling the capsules of hard gelatine (see below), and which at each rotational step of this carrousel, transmits to the said shaft 2 an alternate 180° rotation, as indicated by the arrow 8. The same shaft 2 is provided in an intermediate part with an annular recess 9 which is engaged by the rollers 10 of the forked end of a lever 11, which is pivoted at 12 to a fixed support, and which by means of an intermediate button 13 co-operates with the profile of a cam 14 which rotates on the shaft 15, and is activated by the device of a known type schematically indicated 6, connected in phase with the carrousel 200 for handling the hard gelatine capsules, all such that after each alternate 180° rotation, when the said carrousel 200 is at a standstill, the shaft 2 is raised and lowered by the correct amount.

Figure 3:
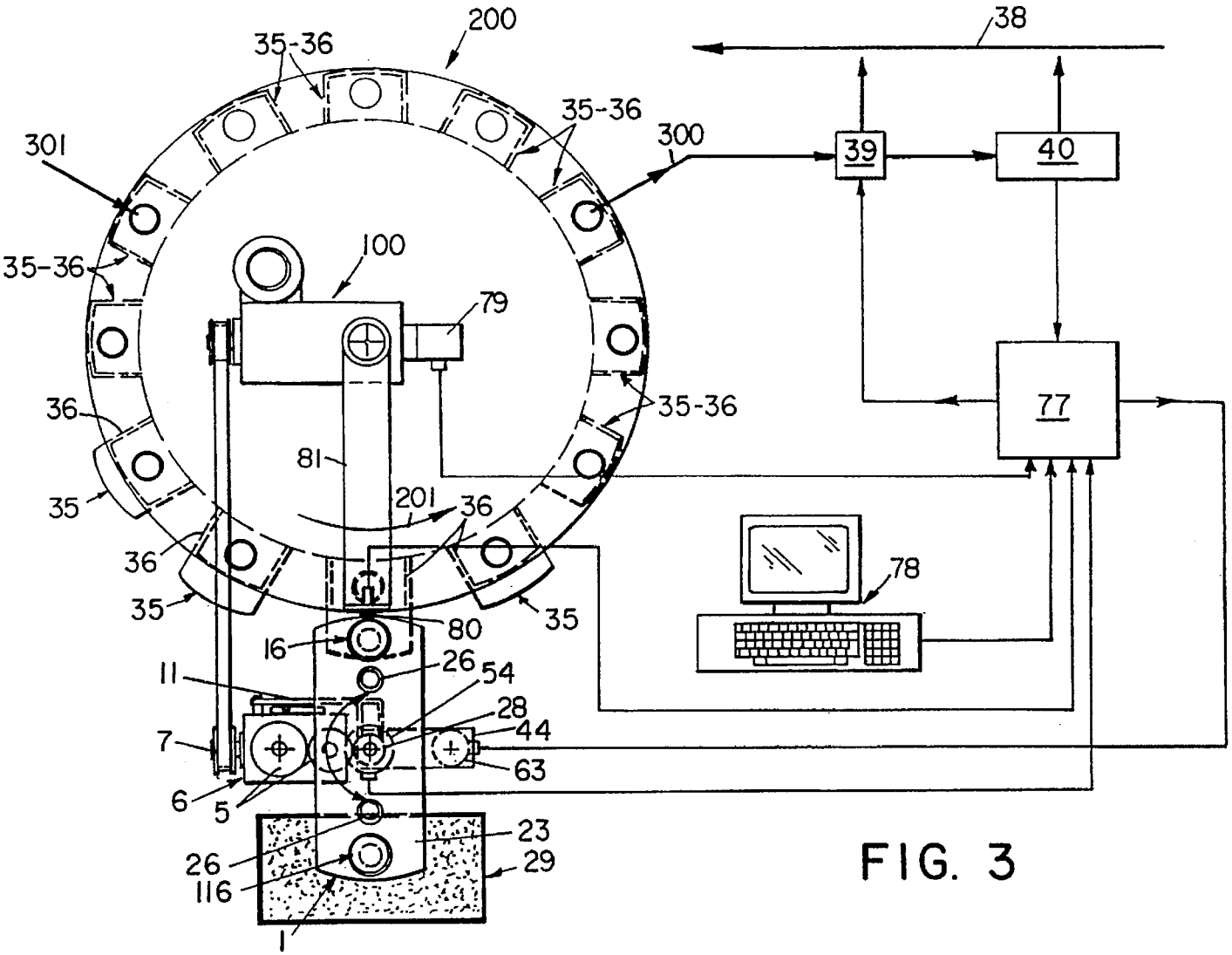
FIG. 3 is a simplified, schematic plan view of an improved machine according to the invention, for automatic packaging of doses of product in hard gelatine capsules

On the carrousel 1 there are mounted in a known manner, equidistantly from the shaft 2, at an angular distance from each other of 180°, and vertically, the bodies of two groups of volumetric distributors 16, 116, the tube 17 of which is oriented downwards and is open at the base. In FIGS. 1 and 3, for the sake of simplicity, reference is made to a carrousel 1 which is provided with only two opposite volumetric distributors 16, 116. In the tube of these distributors, there moves axially and with limited radial play, a small piston 18 which is associated with a piece 19 which is driven axially in the body of the distributors, is thrust upwards by a spring 20, and in its top part is provided radially with a pin 21 which projects from the said body through at least one longitudinal slot, not shown, and is normally supported on the stops 22 of a plate 23 which is parallel to the carrousel 1 and is provided with holes 24 for free passage of the body of the distributors. The plate 23 is normally provided with guide bushes 25 through which there slide vertical pins 26 which are integral with the carrousel 1, and is provided in its centre with a barrel nut 27 which co-operates with the screw 28, which according to the known art is mounted such as to rotate on the said carrousel 1. The screw 28 provides axial connection of the plate 23 to the carrousel 1, whereas the bushes and pins 25, 26 provide the necessary guidance between the two parts.

The axial position of the plate 23 determines the distance between the small piston 18 and the lower free edge of the tubes of the distributors, and thus the volume of the product distribution chamber. In order to vary this volume, it is necessary to screw or unscrew the screw 28, as described in the introduction of the present description.

According to the known art, after alternate rotation of the carrousel 1, the tube-type distributors 116 are disposed for example above a store 29 containing a correct layer of product 30 into which the distributors are plunged such that their lower chamber is filled with product. Subsequently, on the upper end of the movement piece of the distributors 116, there act optional thrust devices 31 which are mounted in a known manner on a structure 82 with the interposition of registers 32, which thrust devices compact correctly the dose of product inserted in the lower chamber of the distributors, after which the said thrust devices are raised, and the carrousel 1 is also raised in order to extract the distributors from the store 29, and is then rotated in order to transfer the distributors 116 to the position of those 16 and vice versa. Whilst the distributors 116 are aligned with the store 29 and are lowered into the latter in order to collect the dose of product as previously described, on the opposite side the distributors 16 containing the dose of product 33 are lowered above the base 34 of a hard gelatine capsule, which is supported by one of the angularly equidistant and radially mobile seats 35 of the carrousel 200, which handles the capsules (see below), and which supports, above the seats 35, corresponding fixed seats 36 for accommodating the cover 37 of the capsules. When the distributors co-operate with the carrousel 200 and are lowered onto the latter as in the example in FIG. 1, the thrust devices 131 which are mounted on the structure 82 with registers 132 act, in order to thrust axially downwards the plunger 18 of the distributors, and to unload the dose of product 33 into the base 34 of the capsule, after which the thrust devices 131 are raised and the carrousel 200 rotates by one step in order to allow the distributors 16 to return to the condition required for the purpose of dosing the product.

During the step rotation of the carrousel 200 in the direction indicated in FIG. 3 by the arrow 201, the base of the capsules can co-operate with a plurality of distribution carrousels for various products, after which the supports 35 are returned to the original position in which the base 34 is aligned axially with the cover 37, such that appropriate means can raise the base in order to connect it to the cover, and then unload from the carrousel into the station indicated 300 the hard gelatine capsules which are closed and contain the dose or doses of product. In the station indicated 301, means which are also known insert an empty, partially closed gelatine capsule into the seats 35 and 36 which are aligned with one another, and such that the base 34 is oriented downwards, so as to project from the base of the seat 36 and engage partially the seat 35 beneath, into which the base is then transferred by an aspiration extractor beneath, not illustrated since it is of a known type.

Also according to the known art, the capsules which are unloaded from the station 300 of the carrousel 200 reach the means 38 of unloading via an exchange device 39 which is activated cyclically in order to divert the capsules one at a time to at least one weighing unit 40 from which the capsules are then returned to the means 38 of unloading, if their weight is correct, or otherwise are unloaded into other collection means. The weighing unit 40 provides the data concerning the weight of the capsules full of product, which data is used according to the known art in order to inform the operator of any need to regulate the volume of the distributors and, within the context of the present invention, is used as described above.

In a machine of the type described, or in all machines which involve similar requirements, the invention provides the following improvements.

The parts 27 and 28 (FIG. 1) are made with precision components, for example of the recirculating ball type, and as illustrated in FIG. 1, the screw 28 is released from the carrousel 1 and is attached to the upper end of a shaft 41 which passes axially through the shaft 2, which is hollow for this purpose. The lower ends of the two shafts (FIG. 2) each have a grooved shape, as indicated at 42 and 43, such that one projects from the other, and both are inserted in a laterally sealed manner in a fixed box 44, in which the following kinematic devices operate with an oil bath. In the box 44, the grooved end 42 of the shaft 2 engages with the mating inner profile 142 of a ring gear 45 which is supported such as to rotate by the support 46, whereas the grooved end 43 of the shaft 41 co-operates with the mating inner profile 143 of a ring gear 47 which is supported such as to rotate by the support 48, both the supports 46 and 48 being attached to the inner projection 49 of the said box 44.

There is flanged co-axially to the ring gear 47 a hollow hub 50, which projects from the base of the box 44 through lateral sealing means 51, is supported such as to rotate on the bearings 52 by the support 53 which is attached to the base of the box 44, and to the lower part of which there is flanged the body of an encoder 54, the axis of which is connected to the hub 50 by connecting means 55. The support 53 is for example surrounded by a robust bush 56 flanged at the upper end to the base of the box 44, and attached at its lower end to an extension of the base 57 of the carrousel 1. The electrical cable of the encoder 54 passes out through a window 58 in the said support bush 56.

The axial cavities of the ring gears 45, 47, and the axial cavity of the hub 50 have dimensions such as to permit the necessary axial movement of the shaft 2 and the associated shaft 41 of the carrousel 1.

Parallel to the shafts 2, 41, in the box 44, there is mounted such as to rotate by means of opposite bearings 59, 60, a shaft 61 which projects from the base of the same box via lateral sealing means 62, and which is connected at its lower end to the shaft of an electric two-way motor 63, with any suitable torque-limiting device 64 interposed. The motor 63 is flanged to the base of the box 44 by means of the support bush 65.

On the intermediate part of the shaft 61 there is keyed by means of the key 66 the inner part 67, the so-called wave generator, of a type HDUA-2F HARMONIC DRIVE reduction/differential gear, with any suitable reduction ratio, the structural details of which are not described as they are known. 68 and 69 indicate the outer rings of input and output of motion into and from the reduction/differential gear unit, known respectively as the circular spline and dynamic spline. The rings 68 and 69 are attached co-axially to respective ring gears 70, 71, which are mounted such as to rotate on the shaft 61 with the bearings 72, 73 and which engage with respective idle toothed wheels 74, 75 mounted such as to rotate freely on the shaft 76, which is supported by the inner projection 49 of the box 44 and is parallel to the shaft 61. The dimensions of the gears 45, 74, 70, and 71, 75, 47 depend on the reduction ratio of the Harmonic Drive used, and are such that when the motor 63 is at a standstill, the inner shaft 41 rotates at exactly the same speed and in the same direction as the shaft 2 of the carrousel 1.

Figure 2:
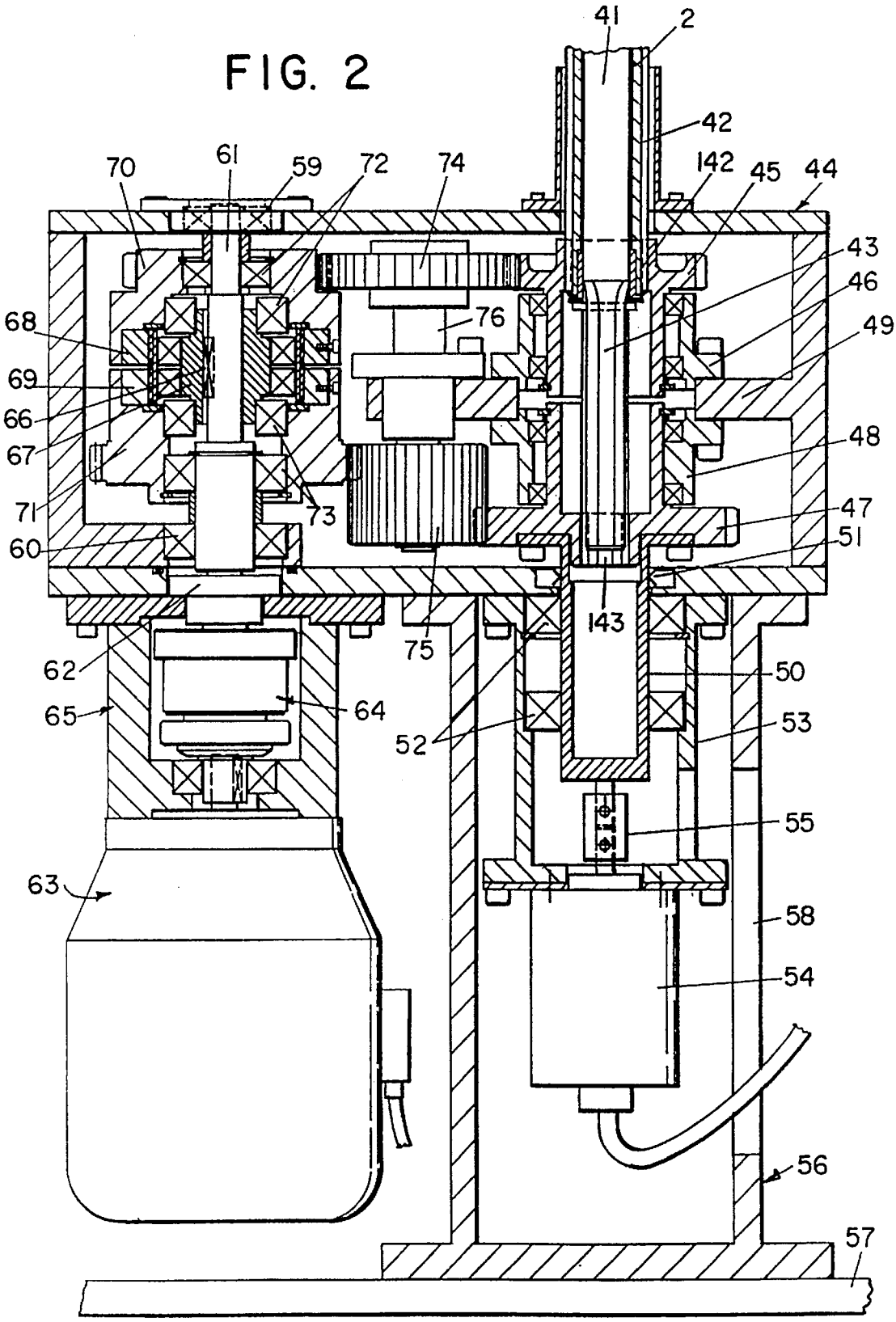
FIG. 2 illustrates laterally and partly in cross-section the lower components of the distributor support carrousel.

The system in FIG. 2 is also such that when the machine is operating, if the motor 63 is actuated to rotate in either direction, by means of the Harmonic Drive a very slow acceleration or deceleration of the shaft 41 is induced, in the direction appropriate for screwing or unscrewing the screw 28, and consequently raising or lowering the plate 23 in FIG. 1, for the required regulation of volume of the distributors.

The system in FIG. 2 is also such that when the machine is at a standstill, if the motor 63 is actuated to rotate in either direction, this gives rise to slow rotation of the shaft 41 in the fixed shaft 2, for volumetric setting of the distributors to the condition required in the individual cases in the work cycle (see below).

FIG. 3 shows that the data obtained from the weighing unit 40 is transmitted to a central processing unit or processor 77, which by means of an interface activates cyclically the exchange 39. Adjacent to this unit 77, there is a keyboard/screen unit 78 for the operations of programming and interrogation, and also connected are the encoder 54, and by means of an interface, the above-mentioned motor 63; there is also connected thereto the encoder 79 which measures the rotation and phase of the carrousel 200 for handling the hard gelatine capsules, and all the parts which derive motion directly from this carrousel, including the outer shaft 2 of the distributor carrousel.

Finally, there is connected to the processor 77 a sensor 80 which is attached for example to an arm 81 which is integral with a fixed part of the carrousel 200, and which, as illustrated in FIG. 1, is located so as to detect the position of maximum raising of the plate 23, and the consequent condition of maximum volume of the tube distributors of the carrousel 1.

At the start of each cycle of work, the plate 23 automatically goes into the highest raised position, in co-operation with the said sensor 80. The torque limiter 64 permits stoppage of the plate 23 against end of travel stops, not shown, without the system being damaged. The limiter 64 also intervenes in the event of obstacles to regulation.

By means of the keyboard 78, the volume of the distributors is regulated to the predetermined value. The processor 77 activates the motor 63 in the correct direction, detects the extent of movement in progress via the encoder 54, and when the predetermined values have been reached, stops the said motor which to this end will be provided with a brake.

When the machine is in operation, the processor 77 reads the weight information of the full capsules which are unloaded from the station 300 of the machine 200, and are weighed cyclically by the unit 40, and compares the data read with that initially obtained from the keyboard 78. If the weight data read differs from that programmed, the processor detects whether these values are deficient or in excess, determines the extent thereof, and if necessary, rotates the motor 63 in the correct direction in order to implement the required regulation of volume of the distributors, which is checked by comparison of the signals obtained from the encoders 79 and 54, all in a manner which can be devised and easily performed by persons skilled in the art.

It is also possible at any time to vary the volume of the distributors via the keyboard 78. In the event of serious abnormalities of operation, the processor 77 stops operation of the machine, and can be set to indicate the cause of stoppage to the unit 78.

It is obvious that the improved machine according to the invention can be controlled even by employees who are not highly qualified, since it carries out automatically regulations of volume of the distributors, without needing any stoppage, and since it can eliminate with the greatest possible safety and technological reliability all the disadvantages of the known art. All the means which regulate the volume of the distributors are disposed externally, and below the working environment of the distributors, where conditions of controlled atmosphere can optionally be introduced, such as to prevent any pollution of this environment.

In order to operate the thrust devices 31–131 with the necessary force for the compression of the product insulated in the tubes of the distributors and thereafter for the expulsion of the dose compressed by the said distributors, the said thrust devices are usually shifted with mechanical systems cam or lever operated and with the interposition of mechanical registers 32–132 enabling a correct setting up of the machine during its construction. The mechanical movement systems works with a predetermined and fixed stroke, so that in order to maintain constant the degree of compression of the dose of product in the distributors, each time that same are registered in volume by their own means, it is necessary to register, through the registers 32 the position in height of the thrust devices 31, in a measure which is directly proportional to the lifting of the piston of the said distributors. This registration is instead not requested for the thrust devices 131 for discharging the doses of product from the distributors, which operate with a fixed stroke which is necessary for the expulsion of the greater and higher dose. The more heigh is the dose, the more lifted is the movement piece of the distributors and greater is the interference of same with the fixed stroke of the thrust devices 131, with consequent major stroke of the said piece, and vice-versa.

Figure 4:
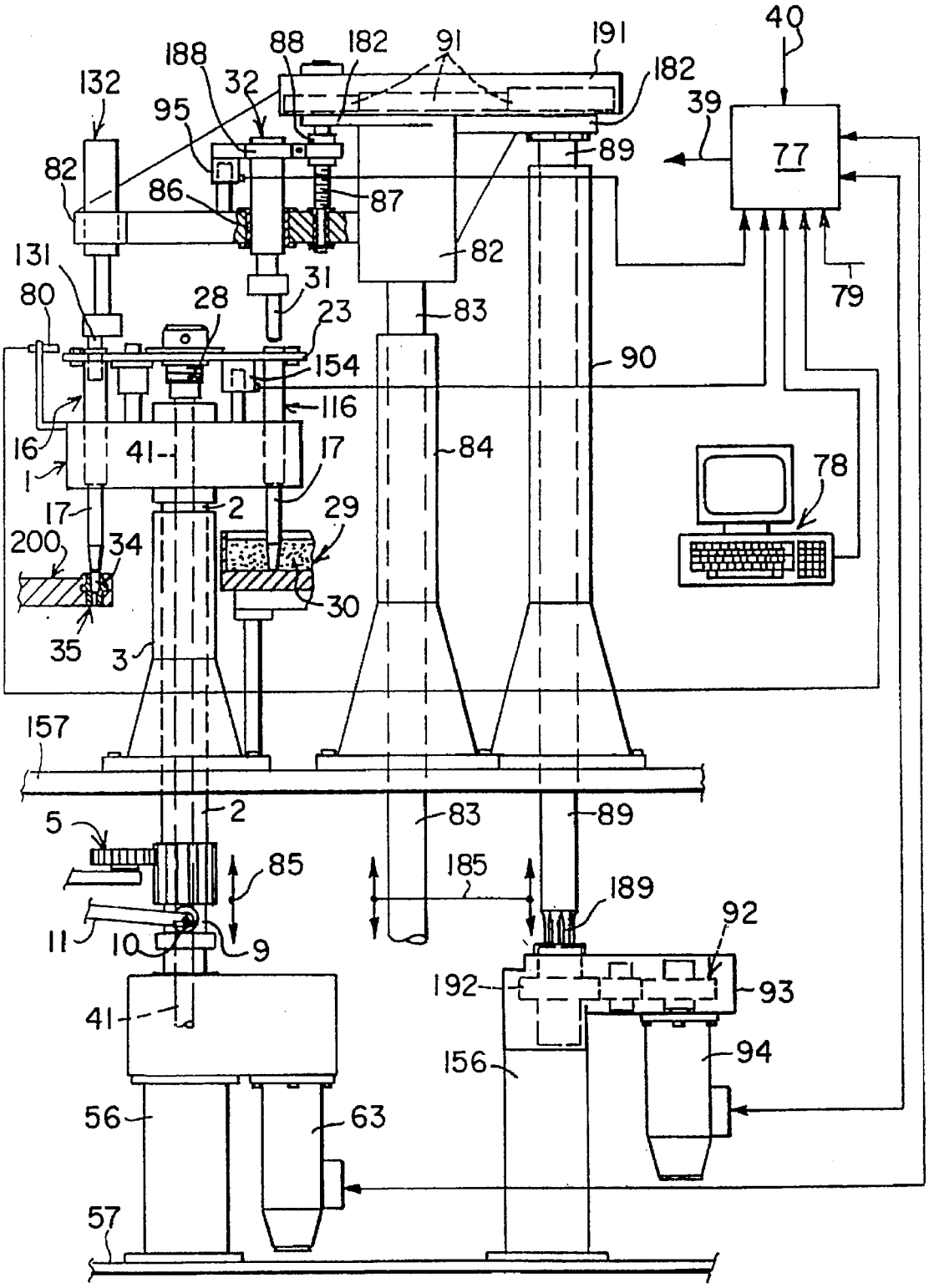
FIG. 4 is a diagrammatic side view with parts sectioned, of the carousel with the distributors and with the means for the automatic registration of the level position of the thrust devices for compressing the doses of product cyclically formed by the same distributors.

Whilst according to the known prior art, also the intervention for regulation on the registers 32 must be effected manually and with the temporary stoppage of the machine, the present improvement is apt to render this same regulation automatic and feasible also whilst the machine is running, as described with reference to FIG. 4.

With numeral 82 the known structure is shown for the support of the body of the registers 32–132, mounted on the end of a vertical rod 83, slidable in a fixed guide 84 and which penetrates with its lower end into the basement 57–157 of the machine, for the connection to lever and cam means not shown, which are similar to the means 9-10-11-15 already considered, which are lifting and lowering the rods 83 in phase with the shaft 2 and with an own law, as diagrammatically shown by the arrows 85 and 185. the rod 83 is lowered together and in synchrony with the shaft 2 and as the latter is stopped, the said rod continues in its downward movement with a fixed stroke by effect of which the thrust devices 31–131 effect respectively the compression of the doses of product in the distributors 116 and the expulsion of the product doses from the distributors 16. Thereafter the shaft 2 is lifted thus lifting also the rod 83, by such a law that when the said shaft is lifted up, the thrust devices 31–131 are out of cooperation with the distributors and are in their high position of starting of a cycle.

Whilst the registers 132 are secured with their body to the structure 82, as in the known art, the body of the registers 32 is mounted with the possibility of axial shifting within suitable vertical guide seats 86 carried by the said structure together with means for the axial registration which for example comprise a vertical screw 87 rotatably supported at the ends by the same structure 82 which is fork-like shaped for this purpose and which cooperates with a nut screw 88 secured to a support 188 to which the body of the registers 32 is secured. By acting on the screw 87 the registers 32 are lifted or lowered so as to adjust the position in height of the thrust devices 31 to the volume variations of the underlying distributors. According to the invention, the structure 82 supports rotatably, for example through its portion 182 supporting also the upper end of the screw 87, the upper portion of a vertical shaft 89 sliding in the suitable fixed guide 90 and which, by its lower end penetrates in the basement of the machine to cooperate with the means which will be described later. The shaft 89 is lifted and lowered together with the structure 82 and with the rod 83. The same portion 182 of the structure 82, is carrying a box 191 containing a positive motion transmission, and for example a gear 91, connecting kinematically the shaft 89 to the screw 87. The lower end of the shaft 89 is, for example provided with longitudinal grooves 189 by which the same shaft is axially shifted while remaining concurrently coupled to an axially grooved pinion 192 of a gear 92 accomodated inside of a box 93 secured to a support 156 and on which the body of a motor 94 with electronic speed and phase control and provided with own braking means is flanged. Also the motor 63 effecting the remote adjustment of the volume of the distributors is preferably of the same kind as the motor 94 previously described.

To the processor 77 already considered with reference to FIG. 3, there are connected through suitable interfaces the motors 94 and 63 and are also connected a pair of transducers for linear movements, for example of the kind known under the name LVDT, utilizing the principle of the electric differential transformer and which transform the distance between the two parts on which they are mounted, in an electric signal which varies with the variation of the distance. One of said transducers 154 is substituting the one 54 of FIG. 2 and is mounted between the carousel 1 and the plate 23 so as to detect the reciprocal movement of said two parts as a consequence of the variations in volume of the distributors. The other transducer 95 is mounted between the supports 188 and 82 so as to detect the linear movement between said two components in consequence of the variations of position in height of the registers 32. Each time that the processor 77 detects from the weighing unit 40 an improper weight value and controls the activation of the motor 63 for the registering of the volume of the distributors, with control in feedback through the transducer 154, at the same time the same processor controls the activation of the motor 94 so as to register according to a predetermined algorithm the position in height of the registers 32 which is controlled in feedback through the transducer 95.

It will be evident that the guide 90 can be eliminated and that the shaft 89 can be arranged axially inside of the rod 83, thus semplifying also the trasmission 91 of the movement, in a manner which is easily conceivable and which may be easily made by an expert in this field. In this case the rod 83 will be blocked by known mens against rotation about its axis, which is a condition which in the solution of FIG. 4 is assured by the shaft 89 and by the guide 90. From the description the bellows-like protections for the screws 87 and 28 have been omitted, as well as other safety means, also of the structural type, inasmuch as not necessary for the comprehension of the invention and because they are evident to the experts and also because they are in part known.

What is claimed is:

1. An apparatus for measuring and dispensing doses of powdered material comprising:

a store having hard gelatine capsules;

a plurality of tube-type distributors, each having a distribution chamber with a changeable volume;

a distributor carousel having a vertical axis, said distributors being mounted onto said distributor carousel about said vertical axis of said distributor carousel;

means for remote regulation of the changeable volume of said distributors;

a centralized drive unit for inserting doses of the powdered material into said hard gelatine capsules, wherein said capsules are collected from said store;

a second carousel for handling said capsules, said second carousel co-operating with said distributor carousel and being activated in phase therewith by said centralized drive unit;

a projection provided externally on said distributors, said projection being connected to a movement piece;

a plate which supports supporting stops, wherein said movement piece cooperates with said stops, said plate being fitted to the distributor carousel and having said remote regulation means and including means for micrometric axial movement;

wherein said axial movement means permits variations of the changeable volume of the distributors, are connected operatively to an upper end of an inner shaft which passes axially through a hollow shaft of the distributor carousel, and project from a lower end of said distributor carousel;

a regulation shaft having a reduction/differential gear unit;

means for interconnecting lower ends of each of said inner and hollow shaft outside a working environment of the distributors, wherein said interconnecting means includes two sets of gears, and said reduction/differential gear unit located on said regulation shaft, said regulation shaft being fitted to a regulation shaft motor which is a two-way electric motor; and a kinematic chain designed such that when the regulation shaft is at a standstill, the inner and hollow shafts of the distributor carrousel rotate at a same speed and in a same direction, whereas when the regulation shaft is rotated in either direction by the regulation shaft motor, the inner shaft rotates slowly in one direction or the other relative to the outer shaft by an extent necessary to provide the required regulation of volume of the distributors resulting from use of the reduction/differential gear unit, independent of whether the hollow shaft of the carrousel is rotating or at a standstill.

2. An apparatus according to claim 1, further comprising:

a first encoder which detects the phase and speed of rotation of the inner shaft of the distributor carrousel;

a processor to which said first encoder is connected, said processor having an interface which activates the regulation shaft motor of said reduction/differential gear unit;

a second encoder connected to said processor which detects the phase and speed of rotation of the second carrousel and of the outer shaft of the distributor carrousel;

a sensor which is also connected to said processor and which detects at least one of a limit volume position of the distributors and a fullest position, wherein at a start of a work cycle, the distributors are in a maximum volume position; and means for controlling the motor which regulates the reduction/differential gear unit, wherein signals corresponding to a required volume condition are generated by said first encoder and monitored by said processor, wherein said control means help regulate the volume of the distributors, and said processor monitors said regulation by processing data received from both said first and second encoders, and from data initially set during programming.

3. An apparatus according to claim 2 further comprising:

a weighing unit which produces weight data, said weight data being transmitted to the processor;

an exchange device which diverts towards said weighing unit the full capsules produced from the second carrousel, and which is served by the distributor carrousel;

means for ensuring the processor activates cyclically said exchange device and said weighing unit;

and wherein said processor compares said weight data with programming data at the start of the cycle, and if necessary, activates automatically the motor for regulating the reduction/differential gear unit in order to carry out the regulation of volume of the distributors.

4. An apparatus according to claim 3, further comprising a plate mounted above said distributor carrousel;

a transducer which encodes linear movements of the internal shaft, said transducer being mounted to detect distance and distance variations between the distributor carousel and the plate;

a mobile element of said distributors;

appendices having stop abutments, said plate carrying said stop abutments integral with said mobile element of said distributors so as to detect the volume of said distribution chamber, in which the processor is prearranged in such a manner that when the processor detects a weight anomaly of the capsules, the processor quantifies the anomaly, transforms the anomaly into a variation of the distance between the plate and the distributor carousel and controls activation or the regulation motor until the variation has been performed by the transducer.

5. An apparatus according to claim 2, further comprising a ring gear and a hollow hub having a lower end and an upper end, and wherein the first encoder which detects the phase and speed of rotation of the inner shaft of the distributor carrousel is fitted onto the lower end of the hollow hub, said hollow hub being flanged at the upper end on the ring gear, said ring gear having an inner grooved profile which co-operates with a lower grooved end of the inner shaft and which passes in a laterally sealed manner through a box which contains the reduction/differential gear unit.

6. An apparatus according to claim 2, wherein the regulation shaft motor has an electronic speed and phase control, and is provided with means for braking said motor.

7. An apparatus according to claim 1, further comprising a fixed box having an oil bath, wherein the reduction/differential gear unit used is a HDUA-2F Harmonic Drive which is disposed in said fixed box, and wherein the gears are disposed within said oil bath, said gears connecting inputs and outputs of said reduction differential gear unit to lower grooved ends of the inner and hollow shafts of the distributor carrousel.

8. An apparatus according to claim 1, further comprising a torque limiter connected to said regulation shaft motor;

wherein said distributors have maximum and minimum limits of regulation movements; wherein the regulation shaft, which regulates the reduction/differential gear unit, is connected to said torque limiter, said torque limiter intervening at the limits of the maximum and minimum regulation movements of the distributors and during intermediate movements if obstacles impede regulation.

9. An apparatus for measuring and dispensing doses of powdered material into hard gelatine capsules having tops and bottoms comprising:

a plurality of tubular distributors, each having a changeable volume;

means for remote regulation of the volume of said tubular distributors;

a first carousel, said distributors being mounted in at least two groups diametrically opposed on said first carousel, having a vertical axis which is cyclically rotated by 180 degrees and lifted and lowered in order to plunge a first group of said distributors in a reservoir with the powdered material in order to fill said first group of distributors with said powdered material while the distributors of a previously filled group abut said bottom pieces of said capsules;

two rotating filling and emptying stations;

a second carousel, said capsule being carried by said second carousel which is rotated stepwise and always in a same direction as said two filling and emptying stations;

a fixed guide having a lower portion;

a vertical bar, said vertical bar carrying a support structure, wherein said structure has registers secured thereon and vertical guides, and wherein said vertical bar slides in said fixed guide;

respective thrust devices mounted on said structure with interposition of said registers;

a means for lifting and lowering said lower portion in phase with the distributors with a fixed stroke such that said thrust devices perform respectively compression of said dose charged by the distributors and discharge of said dose, wherein at least a first one of said registers is a discharge register assigned to the discharge of doses from the distributors, and at least a second one of said registers is a compression register mounted with the ability of sliding vertically within said vertical guides of said support structure, said support structure rotatably supporting at least one vertical screw, wherein said compression registers are secured to a register support, said register support having a nut screw secured thereto, wherein said vertical screw is connected by means for motion transmission which enables the lifting and lowering of said lifting and lowering means, concurrently with said distributors, to a first motor having an electronic phase and speed control and means for braking;

an interface and a processor, wherein said first motor is connected to said interface and to said processor;

a control motor for controlling said distributors, said control motor also being connected to said processor;

a plate, a first transducer and a second transducer, each of said transducers being connected to said processor, wherein said first transducer measures a distance between said carousel and said plate, wherein said second transducer measures linear movements which indicate a distance between said register support and said support structure in such a manner that upon variation of the volume of said distributors, the processor is able to control simultaneously said first motor for automatic variation of a height of said registers under control of said second transducer so as to maintain constant, or within prefixed values, a compression degree of said powder material.

10. An apparatus according to claim 9, further comprising a positive transmission, an upper shaft having an upper end, and a box secured on an appendix, wherein the screw and nut screw means controlling a position in height of the registers of the thrust devices of compression of the doses of powdered material are connected kinematically to said upper end of said vertical shaft through said positive transmission;

said positive transmission being closed in said box, and wherein said appendix supports said regulation means and rotatably supports the upper end of said vertical shaft;

said apparatus further including a basement, and a pinion having an axially grooved cavity located in said position transmission, wherein said vertical shaft crosses said fixed guide and has a lower end, wherein said lower end enters in the basement and connects to said pinion;

said transmission being connected to said electronic phase and speed control for remote control of the position of height of the registers with the thrust devices compressing the doses of powdered material.

11. An apparatus according to claim 10, further comprising a main shaft of said first carrousel; and wherein the vertical shaft connected to the first motor for the remote control of the position in height of the registers with the thrust devices of compression of the doses of powdered material is mounted rotatably in said axially grooved cavity, wherein said vertical rod carries at said upper end said support structure with said registers and wherein expulsion of the doses of powdered material are movable axially in phase with said main shaft of said first carousel in which said main shaft is provided with means for preventing rotation around a longitudinal axis.

12. An apparatus according to claim 10, further comprising a keyboard-videoscreen for programming the processor for an adjustment of the position in height of the registers carrying the thrust devices of compression of the doses of powdered material and for allowing manual control of said registers directly through the keyboard or by a suitable command.

* * * * *